US007794163B2

(12) United States Patent
Bush, III et al.

(10) Patent No.: US 7,794,163 B2
(45) Date of Patent: Sep. 14, 2010

(54) WRITING IMPLEMENT HOLDING DEVICE

(75) Inventors: Chester L. Bush, III, Grand Rapids, MI (US); Brian J. Schroder, Grand Rapids, MI (US)

(73) Assignee: Writing C.L.A.W., Inc., Grand Rapids, MI (US)

( * ) Notice: Subject to any disclaimer, the term of this patent is extended or adjusted under 35 U.S.C. 154(b) by 419 days.

(21) Appl. No.: 11/697,080

(22) Filed: Apr. 5, 2007

(65) Prior Publication Data

US 2008/0014009 A1 Jan. 17, 2008

Related U.S. Application Data

(60) Provisional application No. 60/807,270, filed on Jul. 13, 2006, provisional application No. 60/841,441, filed on Aug. 31, 2006, provisional application No. 60/849,500, filed on Oct. 5, 2006.

(51) Int. Cl.
*A46B 5/04* (2006.01)

(52) U.S. Cl. ..... 401/7; 401/6; 15/443; 434/166

(58) Field of Classification Search ..... 401/6–8, 401/48; 15/437, 443; 434/166
See application file for complete search history.

(56) References Cited

U.S. PATENT DOCUMENTS

| | | | | | |
|---|---|---|---|---|---|
| 147,930 | A * | 2/1874 | Galland | 401/8 |
| 310,771 | A * | 1/1885 | Anderson | 401/7 |
| 423,587 | A * | 3/1890 | Barter | 401/8 |
| 471,556 | A * | 3/1892 | Jolly | 401/8 |
| 500,564 | A * | 7/1893 | Dierlamm | 401/6 |
| 1,702,660 | A * | 2/1929 | Mockel | 434/166 |
| 2,273,044 | A * | 2/1942 | Johnson | 401/8 |
| 2,709,419 | A * | 5/1955 | Appel | 401/8 |
| 3,019,769 | A * | 2/1962 | Ballard | 401/7 |
| 3,402,984 | A * | 9/1968 | Zazzara | 401/8 |
| 3,666,372 | A * | 5/1972 | Lipkowski | 401/8 |
| 4,846,710 | A * | 7/1989 | Campbell | 401/8 |
| 5,310,345 | A * | 5/1994 | Gershon | 401/7 |

(Continued)

OTHER PUBLICATIONS

Printout from www.thepencilgrip.com of "The Pencil Grip" writing grip believed to be available prior to Jul. 13, 2006.

(Continued)

*Primary Examiner*—David J. Walczak
*Assistant Examiner*—Keegan Gumbs
(74) *Attorney, Agent, or Firm*—Van Dyke, Gardner, Linn & Burkhart, LLP

(57) ABSTRACT

A writing implement holding device includes at least one finger receptacle configured to receive a finger of a user and a fastening element attached to the at least one finger receptacle. The fastening element is configured to be removably secured to a writing implement, such as a pen or pencil or the like. The at least one finger receptacle includes side wall portions and an open insert end. The insert end is configured to enable a user to insert at least one finger into the at least one finger receptacle such that the side wall portions surround a segment of the inserted finger or fingers. The finger receptacle may be generally parallel to or generally along the writing implement, such that when the finger of a user is inserted into the finger receptacle, the finger may also be generally parallel to or generally along the writing implement.

22 Claims, 8 Drawing Sheets

U.S. PATENT DOCUMENTS 6,237,194 B1 * 5/2001 Williams ..... 401/6

OTHER PUBLICATIONS

Printout from www.thepencilgrip.com of "The Jumbo Grip" writing grip believed to be available prior to Jul. 13, 2006.
Printout from www.thepencilgrip.com of "The Crossover Grip—The Classic" writing grip believed to be available prior to Jul. 13, 2006.
Printout from www.thepencilgrip.com of "Solo Grip (12 Pack)" writing grip believed to be available prior to Jul. 13, 2006.
Printout from www.thepencilgrip.com of "Air Grip (12 Pack)" writing grip believed to be available prior to Jul. 13, 2006.
Printout from www.thepencilgrip.com of "Foam Grip—5 Pack" writing grip believed to be available prior to Jul. 13, 2006.
Printout from www.thepencilgrip.com of "Extreme Gel Grip—4 Pack" writing grip believed to be available prior to Jul. 13, 2006.
Printout from www.thepencilgrip.com of "Mini Grip (12 Pack)" writing grip believed to be available prior to Jul. 13, 2006.
Printout from www.thepencilgrip.com of "The GripSharp—Single Count" writing grip believed to be available prior to Jul. 13, 2006.
Printout from www.thepencilgrip.com of "Ridged Foam Grip—5 Pack" writing grip believed to be available prior to Jul. 13, 2006.
Printout from www.thepencilgrip.com of "Triangle Grip—5 Pack" writing grip believed to be available prior to Jul. 13, 2006.
Printout from www.peterson-handwriting.com of "EZ Grip" (pp. 2-3) writing grip believed to be available prior to Jul. 13, 2006.
Printout from www.peterson-handwriting.com of "The Pencil Grip" (pp. 4-6) writing grip believed to be available prior to Jul. 13, 2006.
Printout from www.peterson-handwriting.com of "Stetro Gripper" (pp. 7-8) writing grip believed to be available prior to Jul. 13, 2006.
Printout from www.peterson-handwriting.com of "The Solo Grip" (pp. 9-10) writing grip believed to be available prior to Jul. 13, 2006.
Printout from www.peterson-handwriting.com of "Triangle Gripper, Jumbo" (pp. 10-12) writing grip believed to be available prior to Jul. 13, 2006.
Printout from www.peterson-handwriting.com of "Crossover Grip" (p. 13) writing grip believed to be available prior to Jul. 13, 2006.

* cited by examiner

WRITING IMPLEMENT HOLDING DEVICE

CROSS REFERENCE TO RELATED APPLICATIONS

The present application claims the benefit of U.S. provisional applications, Ser. No. 60/807,270, filed Jul. 13, 2006 by Bush III for WRITING IMPLEMENT HOLDING DEVICE; Ser. No. 60/841,441, filed Aug. 31, 2006; and Ser. No. 60/849,500, filed Oct. 5, 2006, which are hereby incorporated herein by reference in their entireties.

BACKGROUND OF THE INVENTION

The present invention is directed to a holding element or guide element for a writing implement, and in particular to a writing aid for teaching and/or assisting individual's to hold a writing implement, such as a pen or pencil or the like.

When learning to write, many people have trouble getting used to the correct way in which to hold a pen or pencil. The correct hand and finger positioning may feel awkward, and often the fingers of the learner will slip into an incorrect position. As a result, the learner may develop poor writing habits, which may be difficult to break.

To aid a person when learning to write, devices known in the art as "pencil grips" have been provided. Pencil grips are adapted to be attached to a writing utensil and provide slight indentations onto which the learner's fingers may be placed. However, the learner's fingers are not directed to or secured in a correct position. Nor are the learner's fingers prevented from slipping to an incorrect position. Thus, poor writing habits may still be developed, even with the use of these types of devices.

SUMMARY OF THE INVENTION

The present invention provides a holding or guide element or writing aid that may be used to properly position one or more fingers, such as the thumb, forefinger, and middle finger, of a user about a writing implement, such as a pen or pencil or the like, in the correct orientation for teaching proper writing form. The writing aid may also assist individuals with hand and/or finger infirmities in holding a writing implement.

According to an aspect of the present invention, a writing implement holding device or element comprises at least one finger receptacle configured to receive a finger of a user and at least one fastening element attached to the at least one finger receptacle. The at least one fastening element is adapted to being removably secured to a writing implement, such as a pen or pencil or the like, to aid use of the writing implement when the user inserts at least one finger into the at least one finger receptacle. The at least one finger receptacle includes side wall portions and an open insert end, which is configured to enable a user to insert a finger into the finger receptacle such that the side wall portions surround a segment of the inserted finger.

The at least one finger receptacle may be arranged or oriented generally parallel to an axis of the fastening element, such that the finger or fingers of the user is/are generally parallel to the writing implement when inserted into the receptacle or receptacles, and when the writing aid is attached to a writing implement. The finger receptacle may be flexibly attached to the fastening element, such as via at least one flexible link or attaching element, such that the user may adjust their finger position relative to the fastening element and the writing implement, while remaining generally at or near the proper finger position for holding the writing implement. Optionally, the writing aid may include one, two or three finger receptacles and may include one or more fastening elements for affixing the writing aid to a writing implement.

The writing aid thus provides a readily useable device for teaching younger children the proper form for holding pens or pencils or crayons or markers or the like. The writing aid is readily applied to and removed from a variety of writing implements and enables a child or adult to be trained in proper writing technique while limiting the need for an instructor to manually position and/or hold the user's hand to the writing implement. The writing aid also provides a convenient device to assist individuals with hand and/or finger infirmities in holding a writing implement.

These and other objects, advantages, purposes and features of the present invention will become apparent upon review of the following specification in conjunction with the drawings.

DESCRIPTION OF THE PREFERRED EMBODIMENTS

Figure 1:
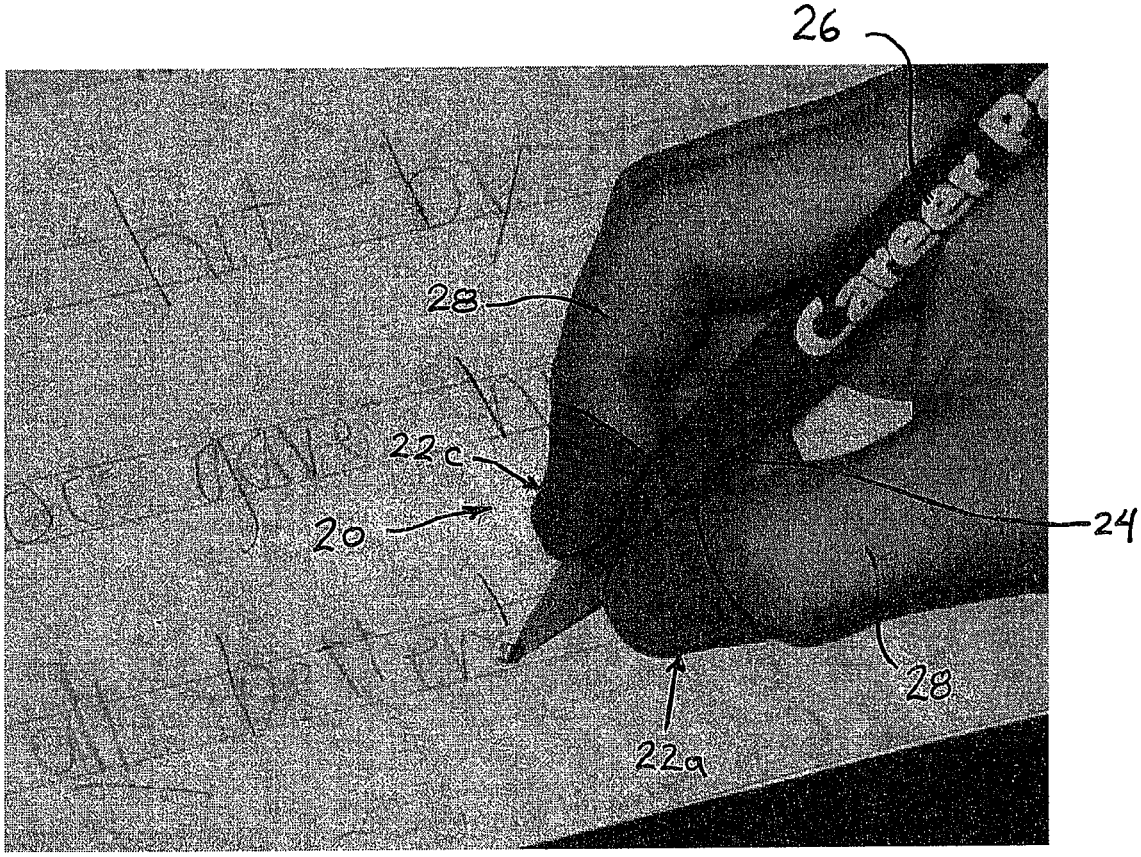
FIG. 1 is a perspective view of a writing implement holding device in accordance with the present invention, shown affixed to a writing implement and being used to receive the fingers of a user.
Figure 2:
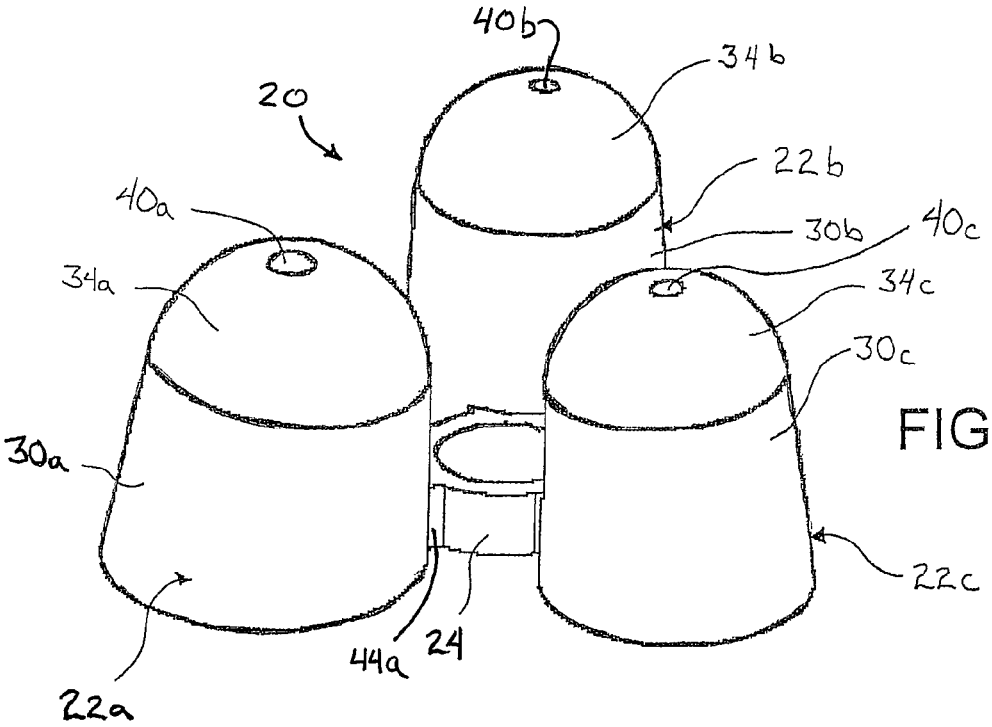
FIG. 2 is a perspective view of the writing aid of FIG. 1, shown removed from the writing implement.

The present invention will now be described with reference to the accompanying figures, wherein the numbered elements in the following written description correspond to like-numbered elements in the figures. A writing implement holding or guiding device or element or writing aid 20 includes three finger receptacles or cones 22*a*, 22*b*, 22*c* disposed about a mounting element or fastening element or ring 24 (FIGS. 1 and 2). Fastening element 24 enables writing aid 20 to be removably affixed to a writing implement 26, such as the pencil shown or other writing instrument or tool, such as a pen or pencil or marker or crayon or the like. A user may then insert his or her fingers 28 into finger receptacles 22*a*, 22*b*, 22*c* of writing aid 20. Finger receptacles 22*a*, 22*b*, 22*c* are positioned about fastening element 24 such that the finger receptacles are generally parallel to an axis of fastening element 24, and thus generally parallel to the writing implement when the writing aid 20 is attached to writing implement or pen or pencil 26. As a result, the fingers 28 of the user are also generally parallel to the writing implement or pen or pencil 26 when inserted into the receptacles when the writing aid is attached to the writing implement. Thus, with the use of writing aid 20, the pen or pencil 26 is held by the user with proper form. Thus, writing aid 20 is well adapted as a training device for teaching children how to properly hold a writing implement 26, such as when learning how to write. Furthermore, a writing aid with alternatively sized and/or shaped finger receptacles may be used to assist adults or other individuals with hand afflictions or infirmities to hold a writing implement, such as individuals having arthritis, loss of finger/hand strength associated with advanced age, or the like.

Optionally, and desirably, writing aid 20 may be unitarily constructed or molded (such as injection molded) from an elastomeric or flexible material such that the writing aid is able to at least partially or substantially conform to a user's fingers 28. For example, writing aid 20 may be formed from a thermoplastic rubber (TPR) or from a polyvinyl chloride (PVC) material or a neoprene rubber compound or other suitable flexible material, and may be formed in different colors and/or sizes. The flexibility of writing aid 20 also provides a user with limited movement of the finger receptacles about the fastening element and about the writing implement to enable the user to feel some control of the writing implement and/or develop motor skills associated with writing. The flexible material also allows the fastening element or ring to expand or stretch to receive the writing implement therethrough, and thus may readily adapt to different sized and/or shaped writing implements. It should be appreciated however, that the writing aid may be constructed of a less flexible or inflexible material and still function as intended within the scope of the present invention.

Figure 3:
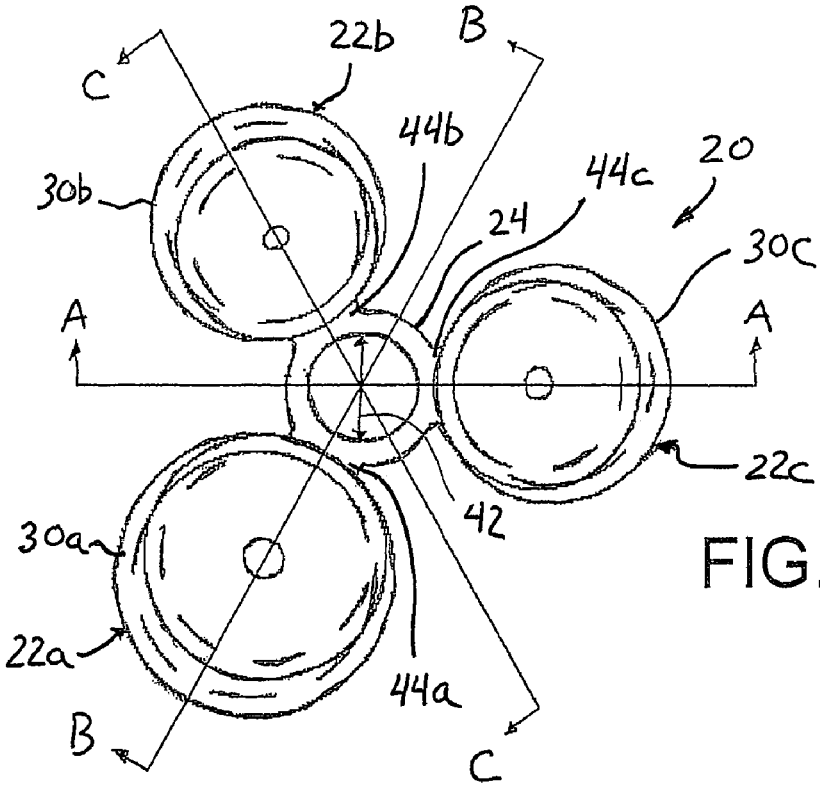
FIG. 3 is an end view of the writing aid of FIG. 2.
Figure 6:
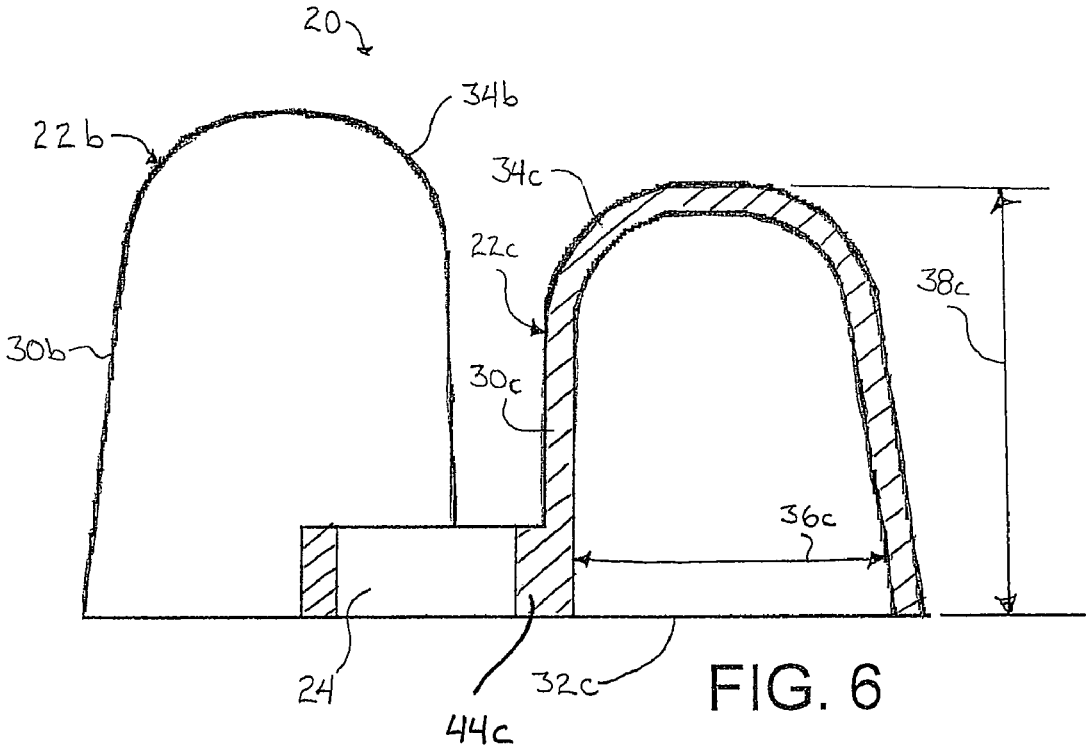
FIG. 6 is a side elevation and partial sectional view of the writing aid taken along the line A-A of FIG. 3.
Figure 7:
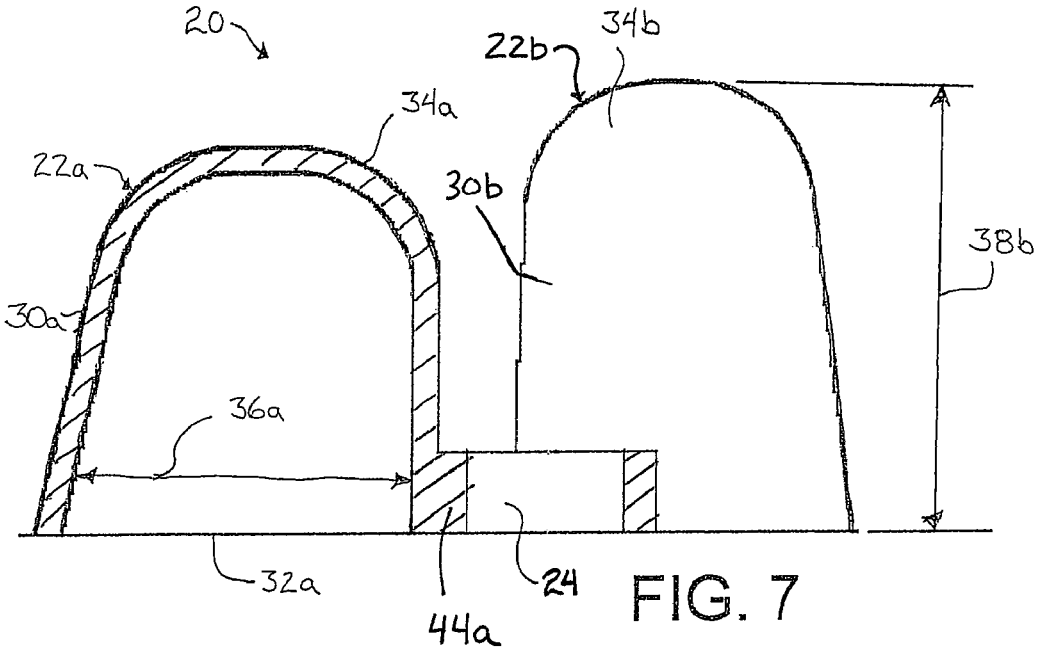
FIG. 7 is a side elevation and partial sectional view of the writing aid taken along the line B-B of FIG. 3.
Figure 8:
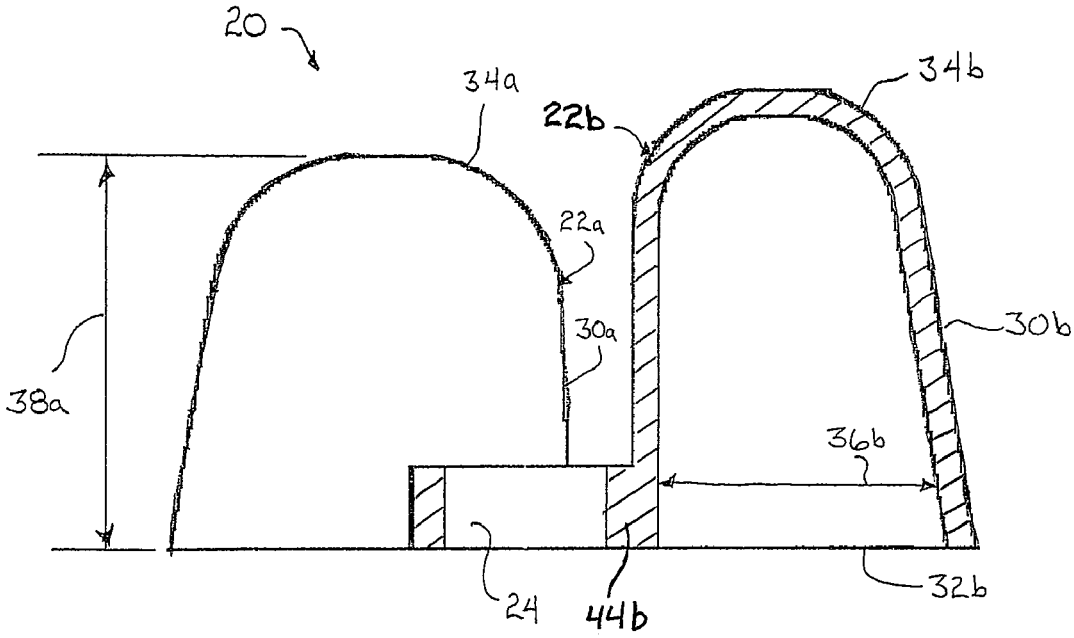
FIG. 8 is a side elevation and partial sectional view of the writing aid taken along the line C-C of FIG. 3.

In the illustrated embodiment, writing aid 20 includes a thumb receptacle or receiving element 22*a*, a middle finger receptacle or receiving element 22*b*, and a forefinger or pointer finger or index finger receptacle or receiving element 22*c*. As shown in FIGS. 3, 7, and 8, thumb receptacle member 22*a* has a slightly larger inner diameter 36*a* relative to the inner diameter 36*b* of middle finger receptacle 22*b* and the inner diameter 36*c* of forefinger receptacle 22*c* to accommodate the thumb of an individual. Further, and as can be seen with reference to FIGS. 6-8, middle finger receptacle 22*b* is constructed to have a slightly greater length 38*b* relative to the length 38*a* of thumb receptacle 22*a* and the length 38*c* of forefinger receptacle 22*c*.

Figure 4:
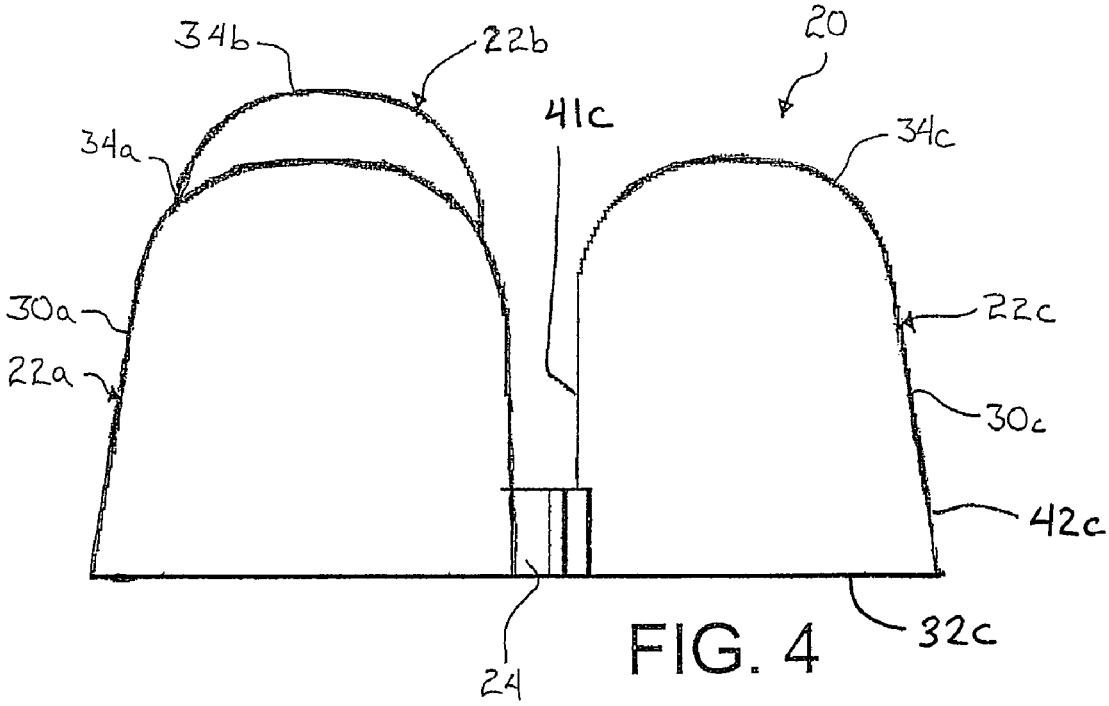
FIG. 4 is a side elevation of the writing aid of FIG. 2.
Figure 5:
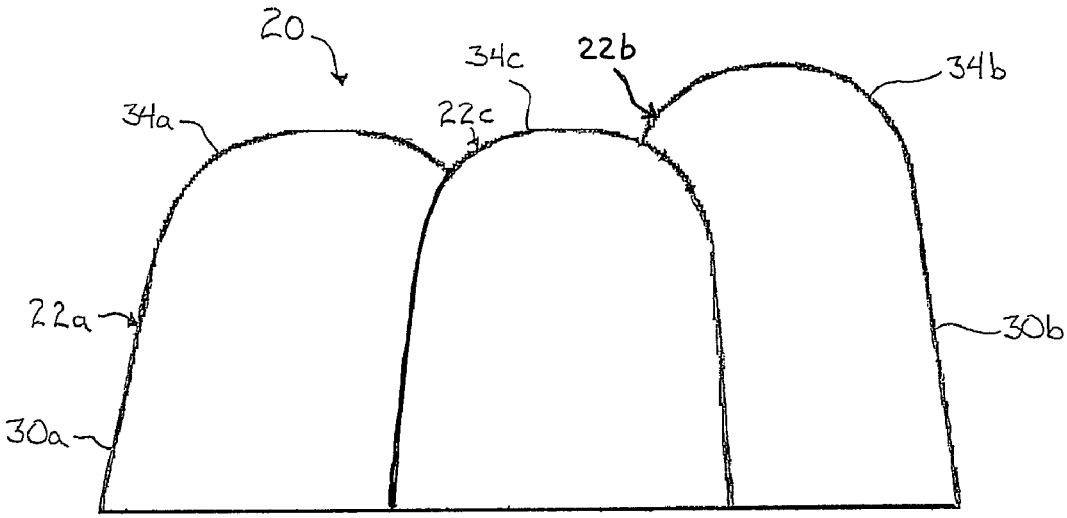
FIG. 5 is another side elevation of the writing aid of FIG. 2.

Each receptacle 22 is formed to have a generally cylindrical or conical side wall portion 30*a*, 30*b*, 30*c*. The conical shape of the side wall portions enhances the ability of the receptacles to receive the fingers of the user, while providing a substantial gripping surface at the writing implement. As previously stated, the finger receptacles of the writing aid may be connected to the fastening member such that the longitudinal axes of the receptacles are positioned generally parallel to or generally along the longitudinal axis of fastening element 24, and thus generally parallel to or along the writing implement when the writing aid is attached to the writing implement. In an embodiment in which the finger receptacles include conical side wall portions, the parallel configuration is achieved by securing the receptacles to the fastener member such that the inner side walls of the receptacles are generally parallel to the writing implement, while the outer side walls tend to flare radially outward and away from the fastening element and the writing implement. For example, as shown in FIG. 4, inner side wall portion 41*c* of receptacle 22*c* is generally parallel to an implement that may be inserted into fastening element 24, while outer side wall portion 42*c* flares radially outward in comparison with inner side wall portion 41*c*.

Each finger receptacle 22*a*, 22*b*, 22*c* includes an open insert end 32*a*, 32*b*, 32*c*, respectively, and may have closed ends or cap portions 34*a*, 34*b*, 34*c* opposite the insert ends. As shown in FIGS. 2 and 3, finger receptacles 22*a*, 22*b*, 22*c* may have an aperture or hole 40*a*, 40*b*, 40*c* through end or cap portion 34*a*, 34*b*, 34*c* to enable air flow or breathing when a finger 28 is inserted into the finger receptacle. Apertures 40*a*, 40*b*, 40*c* also enable a user's fingers 28 to be more readily removed from the respective finger receptacles 22*a*, 22*b*, 22*c* by inhibiting the formation of a vacuum therein as the user pulls or moves his or her finger from the receptacle. Although a single breathing hole is illustrated, multiple variously configured and located apertures may alternatively be provided on or through the finger receptacles, or the finger receptacles may not include an aperture through the end or cap portion of the finger receptacle, while remaining within the spirit and scope of the present invention. The open insert end is configured to receive a user's finger when the user inserts, his or her finger into the finger receptacle, whereby, the side wall portion 30*a*, 30*b*, 30*c* substantially surround a segment or portion of the inserted finger, in order to retain the finger at the writing aid and writing implement.

As best seen in FIGS. 3 and 6-8, each finger receptacle 22*a*, 22*b*, 22*c* may be attached to the fastening element 24 via a respective connecting element or link 44*a*, 44*b*, 44*c*. The links 44*a*, 44*b*, 44*c* may comprise flexible links that allow for some relative movement between the finger receptacles 22*a*, 22*b*, 22*c* and the fastening element 24, such as to allow a user to adjust or modify the position or orientation of his or her fingers relative to the fastening element and writing implement, while keeping the fingers generally at or near the desired or appropriate orientation for properly holding the writing implement. The links 44*a*, 44*b*, 44*c* may space the finger receptacles 22*a*, 22*b*, 22*c* radially outward from the fastening element and may flex to allow for the user to use his or her fingertips to engage the writing implement during use. For example, the receptacles and/or connecting links may flex to allow the finger receptacles to move radially inward for engagement with the pen or pencil, or may flex sidwardly or pivot relative to the fastening element to allow the user to move his or her fingers so as to be at an angle relative to the longitudinal axis of the fastening element and pen or pencil. Optionally, and desirably, the links 44*a*, 44*b*, 44*c* connect or attach the finger receptacles to the fastening element at or near the open insert ends of the finger receptacles to support the open insert ends relative to the fastening element and writing implement to ease insertion of the user's fingers into the finger receptacles.

Optionally, the illustrated writing aid 20 may be sized for use by children of approximately 2 to 8 years of age. For example, inner diameter 36*a* of thumb receptacle 22*a* may be approximately 0.5 inches or thereabouts, while the inner diameter 36*b* of middle finger receptacle 22*b* and the inner diameter 36*c* of forefinger receptacle 22*c* may both be approximately 0.4 inches or thereabouts. Also, for example, the length 38*b* of middle finger receptacle 22*b* from insert end 32*b* to cap portion 34*b* may be approximately 0.8 inches or thereabouts, while the lengths 38*a*, 38*c* of thumb receptacle 22*a* and forefinger receptacle 22*c* may both be approximately 0.5 inches or thereabouts. It should be appreciated that alternatively sized receptacle members may be used and still function as intended. For example, writing aids may be constructed to have smaller or larger finger receptacles for use by children having differently sized fingers or for targeting more specifically at a particular age of size group, while remaining within the spirit and scope of the present invention.

Optionally, the writing aid may be constructed for teens or adults and men or women, for aiding such groups of individuals to hold writing implements. For example, an embodiment of the writing aid adapted for adults, inner diameter 36*a* of the thumb receptacle 22*a* may be approximately 0.7 inches or thereabouts, while the inner diameter 36*b* of the middle finger receptacle 36*b* and the inner diameter 36*c* of forefinger receptacle 22*c* may both be approximately 0.6 inches or thereabouts. Also, the length 38*b* of middle finger receptacle 22*b* from insert end 32*b* to cap portion 34*b* may be approximately 1.1 inches or thereabouts, while the lengths 38*a*, 38*c* of thumb receptacle 22*a* and forefinger receptacle 22*c* may be approximately 0.8 inches or thereabouts and 0.7 inches or thereabouts, respectively.

Figure 9:
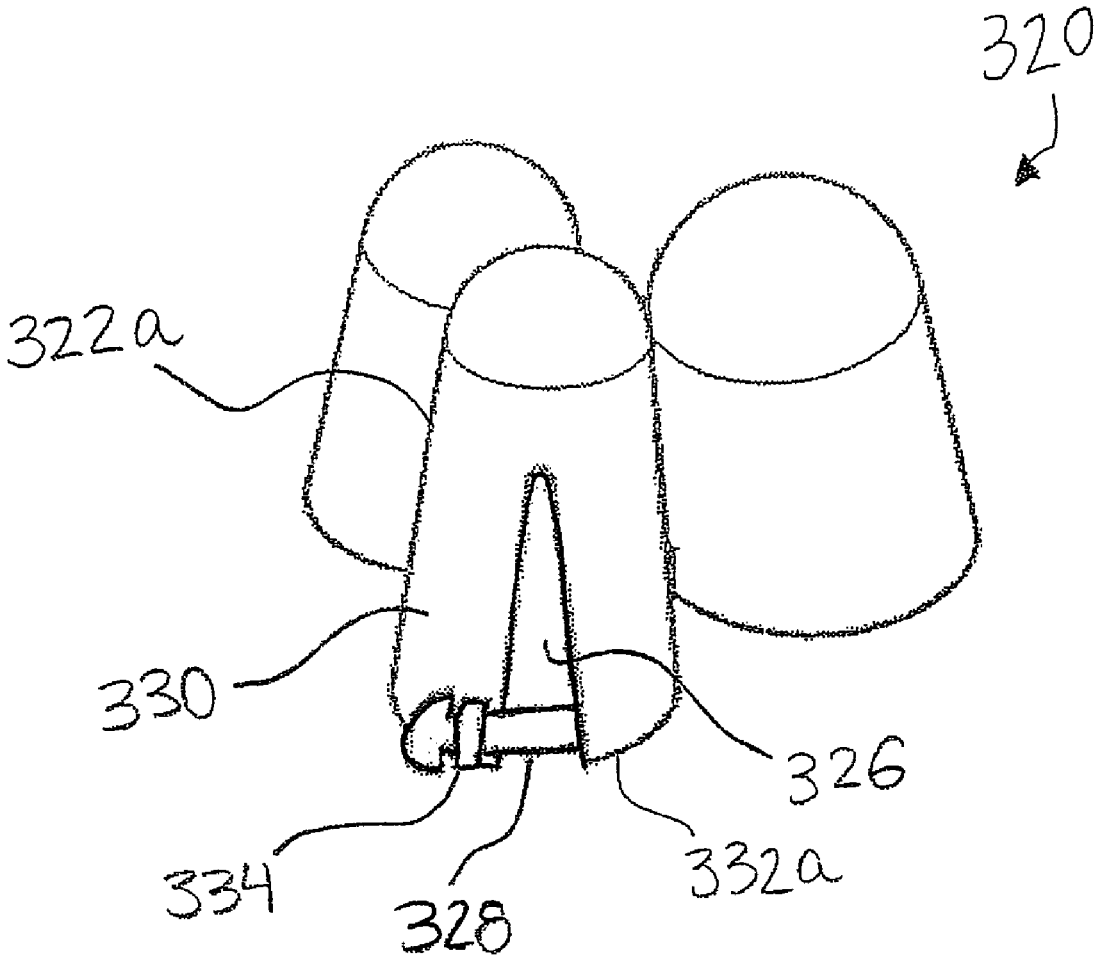
FIG. 9 is a perspective view of another writing aid in accordance with the present invention, having an adjustable strap.

Optionally, the writing aid may include adjustable receptacles that are adapted to fit a broad range of finger sizes. For example, as shown in FIG. 9, a writing aid 320 includes a finger receptacle 322*a* having a slot 326 in the side wall portion 330 of the receptacle. Slot 326 may be tapered, such that the slot widens at an open insert end 332*a* of finger receptacle 322*a*. An adjustable belt or strap or adjusting element 328 is connected to the receptacle on one side of slot 326, such as near open insert end 332*a*. A catch or clasp 334 is connected to receptacle 322*a* at a side wall portion of receptacle 322*a* at the opposite side of slot 326. Clasp 334 is adapted to receive a portion of strap 328, such that strap 328 may be selectively adjusted to tighten or release side wall portion 330 of receptacle 322*a* about an inserted finger of a user. Clasp 334 is also adapted to retain or secure strap 328 in a selected position when a proper or comfortable fit is achieved. Although writing aid 320 is shown with finger receptacle 322*a* having the adjustable slot and strap configuration, the other finger receptacles of the writing aid may also or otherwise have the adjustable slot and strap configuration. Thus, writing aid 320 is adapted to fit a broad range of finger sizes, such that one writing aid may be used for both adults and children. Writing aid 320 may otherwise be substantially similar to writing aid 20, discussed above, such that a detailed discussion of the writing aids need not be repeated herein.

As shown in FIG. 3, the illustrated fastening element 24 is formed as a generally circular ring or band. As shown, finger receptacles 22*a*, 22*b*, 22*c* are attached or joined to fastening element 24 via respective connecting links 44*a*, 44*b*, 44*c*, and are generally evenly spaced about fastening element 24. Thus, thumb receptacle 22*a*, forefinger receptacle 22*c*, and middle finger receptacle 22*b* are all attached to fastening element 24 approximately 120 degrees apart. Alternative spacings, however, may be employed while remaining within the spirit and scope of the present invention. Fastening element 24 is adapted to receive a writing implement therein, so as to be generally affixed at the outside surface of the writing implement 26, with the writing implement 26 being received into the inner diameter 42 of fastening element 24. In the illustrated embodiment, fastening element 24 is undersized and flexible, so as to be adapted to stretch over the outside diameter of the writing implement 26 and be retained thereon due to the elastomeric nature of the fastening element 24. The fastening element 24 also provides the base at which the finger receptacles are attached and from which the finger receptacles extend radially outwardly therefrom.

In the illustrated embodiment, inner diameter 42 of fastening element 24 is approximately 0.25 inches such that writing aid 20 may be mounted to typical sized pencils, pens, and the like. However, it should be appreciated that alternatively sized and configured fastening elements may be provided for use with alternative writing implements and still function as intended within the scope of the present invention. For example, greater or smaller diameters may be provided to enable use with writing implements such as chalk, highlighters, crayons, or markers. Still further, a non-circular fastening element may be used, such as a generally square or rectangle or hexagonal shaped fastening element. Optionally, a generally open or C-shaped fastening element may be employed that is adapted to be snapped or clasped onto a writing implement rather than being slid along the length of the writing implement. It should also be appreciated that a fastening element may be constructed to be rigid or semi-rigid, with flexible finger receptacles and/or connecting links attached thereto or formed therewith.

Figure 2A:
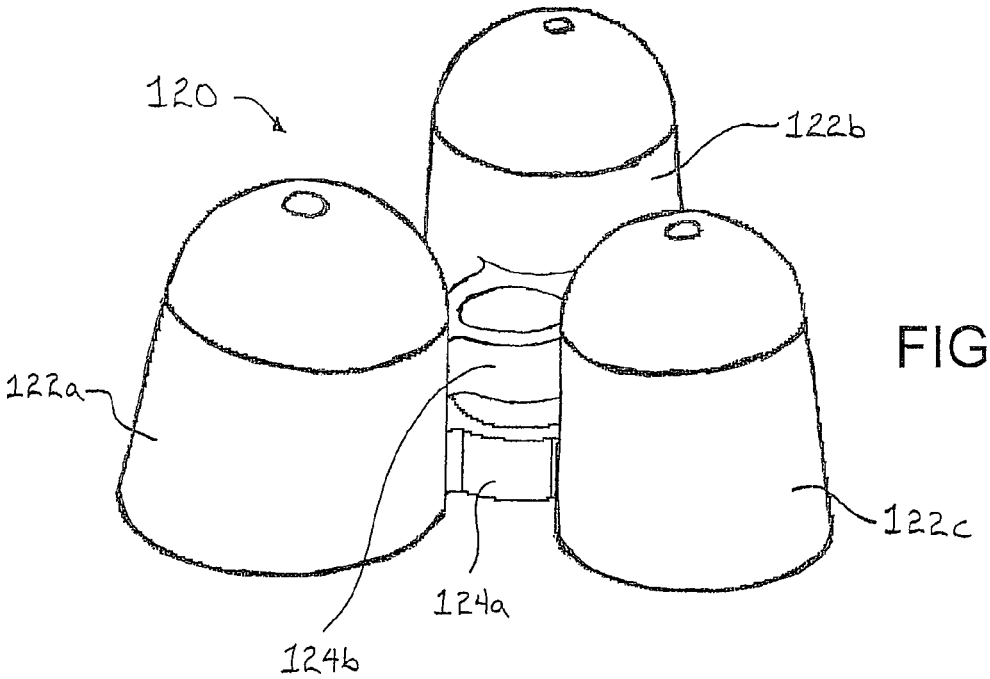
FIG. 2A is a perspective view of another writing aid in accordance with the present invention.

Optionally, the writing aid may have multiple fastening elements. For example, and such as shown in FIG. 2A, a writing aid 120 of substantially similar construction to writing aid 20 is shown. However, writing aid 120 includes two fastening elements or rings 124*a*, 124*b* joining finger receptacles 122*a*, 122*b*, 122*c*. Writing aid 20 may otherwise be substantially similar to writing aid 120, such that a detailed discussion of the writing aids need not be repeated herein.

Figure 2B:
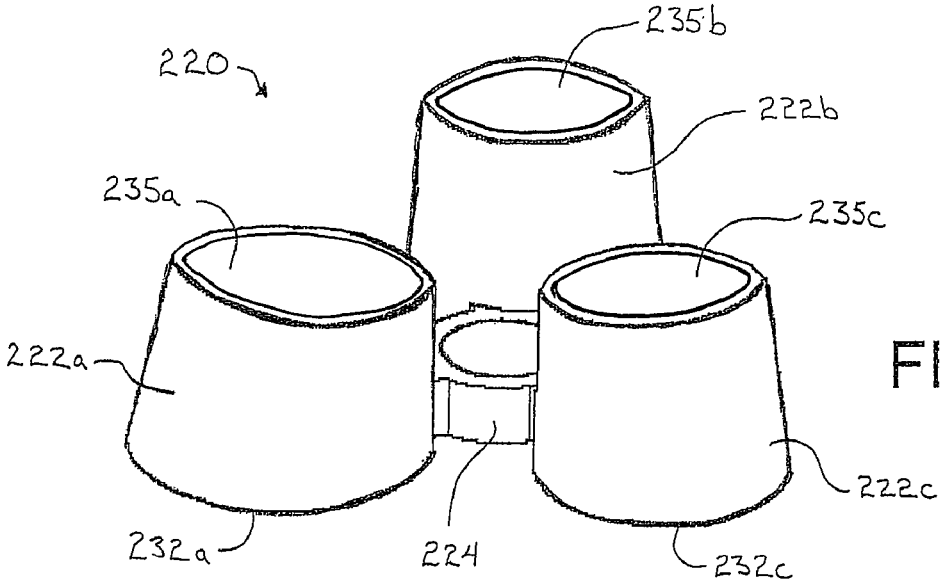
FIG. 2B is a perspective view of another writing aid in accordance with the present invention.

Optionally, the writing aid may be open at both ends of the finger receptacles. For example, and as shown in FIG. 2B, a writing aid 220 includes truncated finger receptacles 222*a*, 222*b*, 222*c* having respective open finger extension ends 235*a*, 235*b*, 235*c* opposite the open insert ends 232*a*, 232*b*, 232*c*. The open insert ends 232*a*, 232*b*, 232*c* enable the tip or end of a user's fingers to partially extend out of finger receptacles 222*a*, 222*b*, 222*c* when the user's fingers are inserted therein. This allows the user's fingers to contact the writing implement, which may thereby provide the user with a greater amount of feel or control when using the writing aid and writing implement. In addition, such contact with the writing implement may also facilitate the transition to use of a writing implement by the user without a writing aid.

Optionally, a writing aid may have fewer than three finger receptacles and still function as intended within the scope of the present invention. For example, a writing aid may have only one or two finger receptacles. Such writing aids may be used, for example, to aid individuals in writing that have one or more injured fingers or that have lost one or more fingers.

Figure 10:
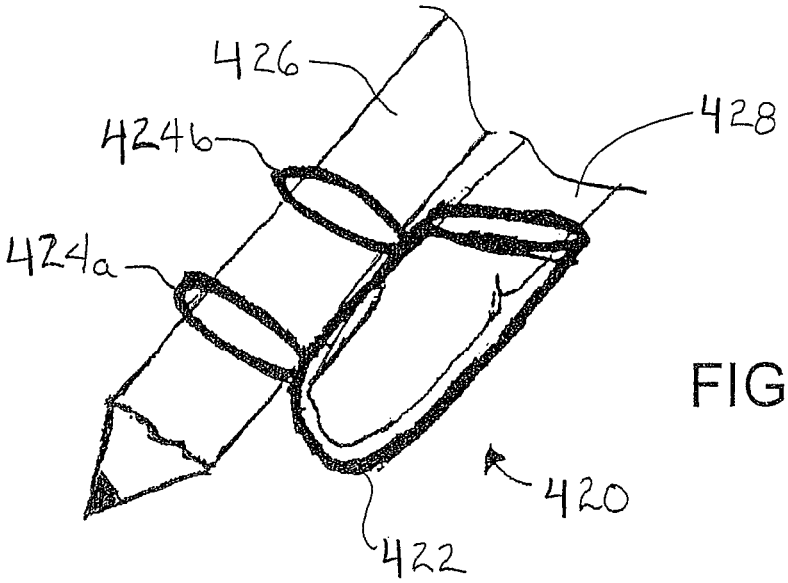
FIG. 10 is a perspective view of another writing aid in accordance with the present invention.
Figure 11:
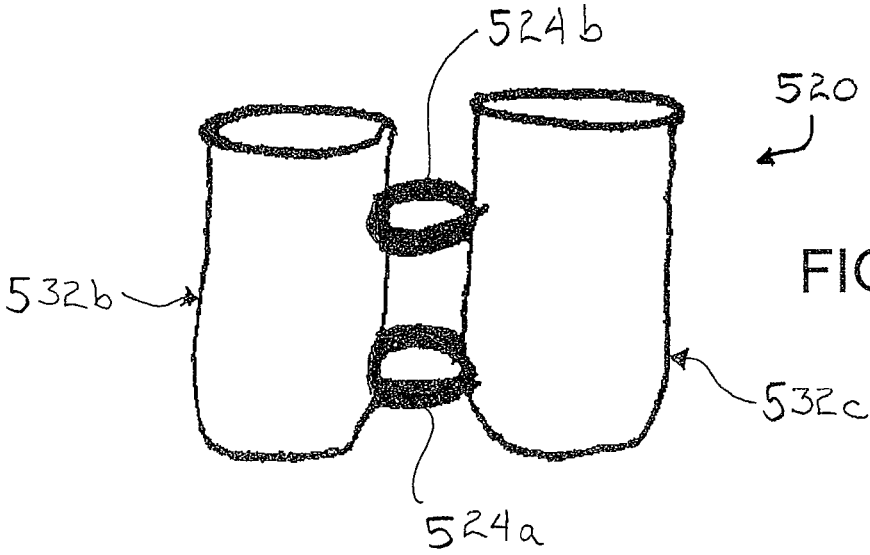
FIG. 11 is a perspective view of another writing aid in accordance with the present invention.
Figure 12:
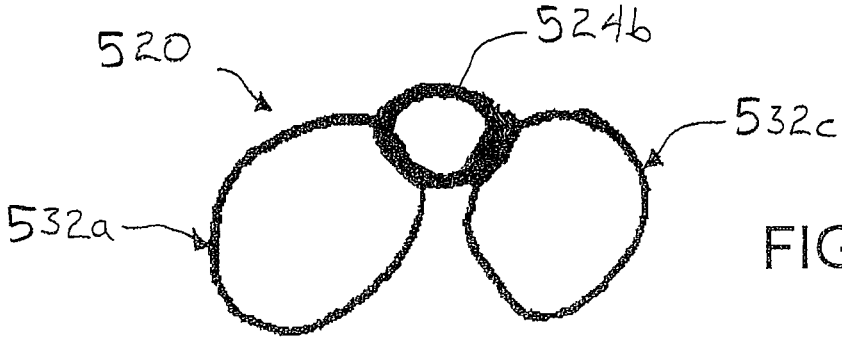
FIG. 12 is an end view of the writing aid of FIG. 11.

For example, and with reference to FIG. 10, a writing aid 420 for aiding writing has a single finger receptacle 422 (for receiving a single finger 428) and two fastening elements 424*a*, 424*b* for attaching the writing aid to the writing implement. Similarly, and with reference to FIGS. 11 and 12, a writing aid 520 has two finger receptacles 522*b*, 522*c* and two fastening elements 524*a*, 524*b*. Finger receptacles 522*b*, 522*c* of writing aid 520 may receive two fingers of a user, such as, for example, the forefinger and middle fingers of a user (or any other two fingers depending on the application of the writing aid). Writing aids 220, 320, 420 and 520 may otherwise be substantially similar to writing aid 20, discussed above, such that a detailed discussion of the writing aids need not be repeated herein.

The finger receptacles of each writing aid illustrated herein are shown as being generally axially aligned when not being used. However, alternative writing aids may be formed having finger receptacles that are not generally axially aligned and still function as intended within the scope of the present invention. For example, although not shown, an alternative writing aid may be formed having a thumb receptacle member and a forefinger receptacle member that are generally axially aligned, with a middle finger receptacle member that is turned or angled relative to the thumb receptacle member and forefinger receptacle member. It should be appreciated that the middle finger of some individuals may be turned or positioned at an angle relative to the thumb and forefinger when holding a writing implement such that the middle finger is approximately or generally perpendicular to the axis of the writing implement. Such an angling of fingers may be accommodated via the angle of the finger receptacles or the flexibility of the finger receptacles and/or the flexibility of the connecting link between the finger receptacles and the fastening element. It should be appreciated that the formation of writing aids from an elastomeric material allows the finger receptacles to move or stretch relative to one another. Other materials, however, may not provide enough flexing of the finger receptacles relative to each other. Thus, having a finger receptacle that is turned in the manner discussed above may be more advantageous with writing aids formed from less flexible materials.

Optionally, a writing aid, such as a writing aid similar to writing aid 20, 120, 220, or 320, for example, may be directly formed with or molded onto a writing implement. The fastening element or elements of such an embodiment may be affixed or molded directly to the shaft of the writing implement. Optionally, the outer shell or shaft of the writing implement may define or form the fastening element, in which case the finger receptacle or receptacles may be secured directly to the writing implement. The outer shell of the writing implement to which the writing aid is molded or attached may be formed of a plastic or polymeric material. Optionally, where a writing aid is secured to a pre-existing writing implement, it is envisioned that the writing aid may be formed or attached to the writing implement by an overmold process or the like.

Therefore, the writing aid of the present invention provides a readily useable device for teaching younger children (or adults) the proper form for holding writing implements. The writing aid may be readily applied and removed to a variety of writing implements and enables a child (or adult) to be trained in proper writing technique while limiting the need for a teacher to manually position and/or hold the child's hand to the writing implement. In addition, the writing aid also provides a convenient device to assist individuals with hand and/or finger infirmities in holding a writing implement.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A writing implement holding device, said holding device comprising:

a first finger receptacle, a second finger receptacle, and a third finger receptacle, each said finger receptacle receiving and containing the distal end of a respective finger of a user when inserted into said finger receptacles, each said finger receptacle including side wall portions, an open insert end, and a distal end opposite said insert end, said insert ends configured for a user to insert fingers into said finger receptacles;

a fastening element having a first connecting link, a second connecting link, and a third connecting link, each said finger receptacle being attached to said fastening element by a separate respective one of said connecting links, with each said connecting link being attached to said side wall portions at said open insert end of a respective said finger receptacle, with attachment of said connecting link to said side wall portions being substantially limited to immediately adjacent said open insert end such that a substantial portion along the axial length of said side wall portions is not attached to a respective one of said connecting links, and wherein each said connecting link comprises a flexible connecting link to allow for movement of said finger receptacles relative to said fastening element with said distal ends being moveable relative to said connecting links;

said fastening element being configured to be removably secured to a writing implement; and wherein said holding device is configured to aid use of the writing implement by a user when the user inserts fingers into respective ones of said finger receptacles when said writing aid is secured to the writing implement wherein the user is able to independently move said finger receptacles to grasp the writing element.

2. The writing implement holding device of claim 1, wherein said first finger receptacle is configured to receive a thumb of a user, said second finger receptacle is configured to receive an index finger of a user, and said third finger receptacle is configured to receive a middle finger of a user.

3. The writing implement holding device of claim 2, wherein said first, second, and third finger receptacles each include generally conical side wall portions, said insert ends being configured to enable the user to insert the respective fingers into said finger receptacles such that said side wall portions surround a segment of the inserted fingers.

4. The writing implement holding device of claim 3, wherein said conical side wall portions have inner side wall portions positioned adjacent to said fastening element and outer side wall portions opposite said inner side wall portions, wherein said inner side wall portions are generally parallel to said writing implement and said outer side wall portions flare radially outward from said writing implement when said writing aid is secured to the writing implement.

5. The writing implement holding device of claim 3, wherein said side wall portion of said first finger receptacle member defines an inner diameter that is greater than the inner diameters defined by said side wall portions of said second and third finger receptacles.

6. The writing implement holding device of claim 1, wherein said distal ends of said first, second and third finger receptacles each include a cap portion.

7. The writing implement holding device of claim 6, wherein said third finger receptacle defines a length from said open insert end to said cap portion that is greater than the lengths defined from said open insert ends to said cap portions of said first and second finger receptacles.

8. The writing implement holding device of claim 6, wherein said cap portions include at least one aperture there through.

9. The writing implement holding device of claim 1, wherein said fastening element comprises an elastomeric fastening ring, said fastening ring being configured to be disposed about the outer circumference of a writing implement.

10. The writing implement holding device of claim 9, wherein said first, second, and third finger receptacles are approximately evenly positioned about said fastening ring.

11. The writing implement holding device of claim 9, wherein said fastening ring is radially expandable to receive a writing implement therein.

12. The writing implement holding device of claim 2, wherein said third finger receptacle is attached to said fastening element at an angle relative to said first and second finger receptacles.

13. The writing implement holding device of claim 2, wherein said finger receptacles are integrally formed with said fastening element.

14. The writing implement holding device of claim 1, wherein at least one of said finger receptacles includes a slot in said side wall portion and an adjustable strap connected to said side wall portion at said slot, wherein said strap may be selectively adjusted to tighten said side wall portion around the inserted finger of a user, and wherein said at least one finger receptacle includes a clasp for securing said adjustable strap at a selected position.

15. The writing implement holding device of claim 1, wherein said at least one finger receptacle includes an open extension end opposite said open insert end, said open extension end being configured to enable a tip portion of the inserted finger to extend out of said at least one receptacle such that the tip portion of the inserted finger is able to contact the writing element.

16. A writing implement holding device, said holding device comprising:

a plurality of finger receptacles, each said finger receptacles receiving and containing the distal end of a finger of a user when inserted into a respective one of said finger receptacles, each of said finger receptacles including side wall portions, an open insert end, and a distal end opposite said insert end, each said insert ends configured for a user to insert a finger into a respective one of said finger receptacles;

a fastening element having a plurality of connecting links, each said finger receptacle being attached to said fastening element by a separate said connecting links, with each said connecting link being attached to a respective said side wall portion at said open insert end of a respective said finger receptacle immediately adjacent said open insert end such that said distal end of each said finger receptacle is not attached to a respective one of said connecting links, and wherein each said connecting link comprises a flexible connecting link to allow for movement of said finger receptacles relative to said fastening element with said distal ends being moveable relative to said connecting links; and wherein said fastening element receives a writing implement there through to removably secure to the writing implement to aid use of the writing implement when the user inserts the distal ends fingers into respective ones of said finger receptacles.

17. The writing implement holding device of claim 16, wherein said writing aid comprises a unitarily formed writing aid molded of an elastomeric material.

18. A writing implement including a writing implement holding device, said writing implement comprising:

an elongated shaft;

a holding device, said holding device being attached to said shaft and including a first finger receptacle, a second finger receptacle, a third finger receptacle, and a fastening element, said finger receptacles receiving and containing the distal end of respective fingers of a user when inserted into said finger receptacles, each said finger receptacle including side wall portions and an open insert end, said insert ends configured for a user to insert fingers into respective ones of said finger receptacles;

said fastening element including a first connecting link, a second connecting link, and a third connecting link with each said finger receptacle being attached to said fastening element by a separate respective one of said connecting links, each said connecting link being attached to said side wall portions at said open insert end of respective said finger receptacles with attachment of said connecting link to said side wall portions being substantially limited to immediately adjacent said open insert end such that a substantial portion along the axial length of each said side wall portions is not attached to a respective one of said connecting links, and wherein each said connecting link comprises a flexible connecting link to allow for movement of said finger receptacles relative to said fastening element;

wherein said holding device is configured to aid use of said writing implement when the user inserts the distal ends of three fingers into respective ones of said finger receptacles, with said finger receptacles guiding and holding the user's fingers at or near a preselected orientation relative to said elongated shaft while enabling a user to move their finger tips within said finger receptacles relative to said connecting links.

19. The writing implement of claim 18, wherein at least one of said finger receptacles is generally parallel to said elongated shaft, and wherein the finger of the user is generally parallel to said elongated shaft when inserted into said at least one finger receptacle.

20. The writing implement of claim 18, wherein said side wall portions of said finger receptacles comprise generally conical side wall portions.

21. The writing implement holding device of claim 16, wherein said plurality of finger receptacles comprises a first finger receptacle, a second finger receptacle, and a third finger receptacle, and wherein said plurality of connecting links comprises a first connecting link, a second connecting link, and a third connecting link.

22. The writing implement holding device of claim 16, wherein said distal ends of each said finger receptacle includes a cap portion.

* * * * *

UNITED STATES PATENT AND TRADEMARK OFFICE

CERTIFICATE OF CORRECTION

PATENT NO. : 7,794,163 B2
APPLICATION NO. : 11/697080
DATED : September 14, 2010
INVENTOR(S) : Chester L. Bush, III and Brian J. Schroder It is certified that error appears in the above-identified patent and that said Letters Patent is hereby corrected as shown below:

Column 9

Claim 16, Line 18, “receptacles” should be --receptacle--

Claim 16, Line 23, “ends” should be --end--

Claim 16, Line 28, “links” should be --link--

Signed and Sealed this
Eleventh Day of September, 2012

David J. Kappos

David J. Kappos
*Director of the United States Patent and Trademark Office*